United States Patent [19]

Rachel

[11] 3,967,598

[45] July 6, 1976

[54] COMBINED ELECTRIC FUEL PUMP CONTROL CIRCUIT INTERMITTENT INJECTION ELECTRONIC FUEL CONTROL SYSTEMS

[75] Inventor: Todd L. Rachel, Yorktown, Va.

[73] Assignee: The Bendix Corporation, Southfield, Mich.

[22] Filed: Dec. 14, 1973

[21] Appl. No.: 425,000

Related U.S. Application Data

[63] Continuation of Ser. No. 158,350, June 30, 1971.

[52] U.S. Cl. ..... 123/32 EA; 123/136; 123/139 E; 123/179 L

[51] Int. Cl.[2] ..... F02G 3/00; F02M 39/00

[58] Field of Search ..... 123/32 RA, 139 E, 136, 123/139 AW, 32 AE, 179 L

[56] References Cited

UNITED STATES PATENTS

| | | | |
|---|---|---|---|
| 2,981,246 | 4/1961 | Woodward | 123/32 EA |
| 3,036,564 | 5/1962 | Giot | 123/139 E |
| 3,456,629 | 7/1969 | Dawgauthier | 123/32 EA |
| 3,587,545 | 6/1971 | Ballou | 123/136 |
| 3,669,081 | 6/1972 | Monpetit | 123/139 E |
| 3,680,537 | 8/1972 | Suda | 123/32 EA |

*Primary Examiner*—Wendell E. Burns
*Assistant Examiner*—Ronald B. Cox
*Attorney, Agent, or Firm*—Gerald K. Flagg

[57] ABSTRACT

A combined fuel pump control circuit, intermittent injection electronic fuel control system is disclosed herein to provide optimum fuel delivery at constant operating pressure to the fuel injector valve means of an electronically controlled fuel supply system and to eliminate fuel return means. By energizing the pump in response to the engine operating parameters which determine the engine fuel requirement, fuel as calculated to meet the fuel requirement is provided thereby eliminating the need for fuel, in excess of that required by the engine, to be recirculated from the area of the engine back to the fuel reservoir. In order to intermittently energize the fuel pump, the pump is provided with signals which correspond to the injector valve energizing signals in timing and duration.

2 Claims, 1 Drawing Figure

TODD L. RACHEL
INVENTOR.

BY Robert A. Benziger

COMBINED ELECTRIC FUEL PUMP CONTROL CIRCUIT INTERMITTENT INJECTION ELECTRONIC FUEL CONTROL SYSTEMS

This is a continuation of application Ser. No. 158,350, filed June 30, 1971.

BACKGROUND OF THE INVENTION

1. Field of the Invention

The present invention relates to the field of electronic fuel control systems for internal combuston engines. More particularly, the present invention relates to that portion of the above noted field which is concerned with direct control of the fuel supply pumping means.

2. Description of the Prior Art

In fuel control systems which provide fuel to reciprocating piston internal combustion engines on an intermittent, or pulse, basis the prior art teaches that the fuel pumps per se are to be energized by a substantially constant level voltage so as to provide fuel to the fuel injector valve means at a fixed, constant pressure and flow rate commensurate with maximum requirements. Typically, these systems provide accumulator means to assist stabilizing fuel pressure with return lines being supplied to return to the fuel reservoir quantities of fuel in excess of that required by the engine. In such systems, it is known that fuel which is recirculated to the vehicle fuel reservoir will contain large amounts of heat which have been picked up from the engine compartment of the vehicle. Such systems usually provide elaborate mechanisms in the reservoir (which is at ambient air temperature) so as to prevent percolation loss of vapor and general increase in the fuel temperature within the fuel tank. One difficulty with an elevated temperature in the fuel reservoir is that hydrocarbon emissions are generated to pollute the atmosphere. An additional problem, of course, is the fact that lost fuel vapors decrease vehicle efficiency and mileage. A further problem with recycling of heated fuel back to the fuel reservoir is the fact that vapor lock situations can occur when heated fuel is drawn into the pump intake and this fuel subsequently vaporizes. It is, therefore, an object of the present invention to provide a control circuit for the fuel pump of such electronic fuel control systems as will permit that pump to operate at the desired fuel flow and pressure rates when necessary for the injection of fuel but which will otherwise not cause fuel to circulate or be pumped.

SUMMARY OF THE INVENTION

The present invention contemplates a means and method adapted to utilize fuel injection command pulses to intermittently energize the fuel pumping means to eliminate the need for circulating fuel through the vehicle engine compartment and to eliminate the fuel return lines and the mechanism used to segregate heated fuel from fuel at ambient temperature. The fuel pumping means are initially energized so that an accumulator/pressure regulator device is charged. Subsequent fuel injecton signals will be transmitted both to the pump and the injector valve means so that the pump may add fuel to the accumulator/pressure regulator in amounts sufficient to replace the quantities of fuel injected by the injector valve means. Additionally, the present invention contemplates addition of signal amplifier means and a unidirectional current flow device in series with the pump and the provision of an energy dissipating current flow path for dissipation of any inductive energy stored in the electrical circuitry of the fuel pumping means.

BRIEF DESCRIPTION OF THE DRAWING

The single FIGURE illustrates an internal combustion engine fuel control system incorporating the fuel pump control means of the present invention.

DETAILED DESCRIPTION OF THE PREFERRED EMBODIMENT

Figure 1:
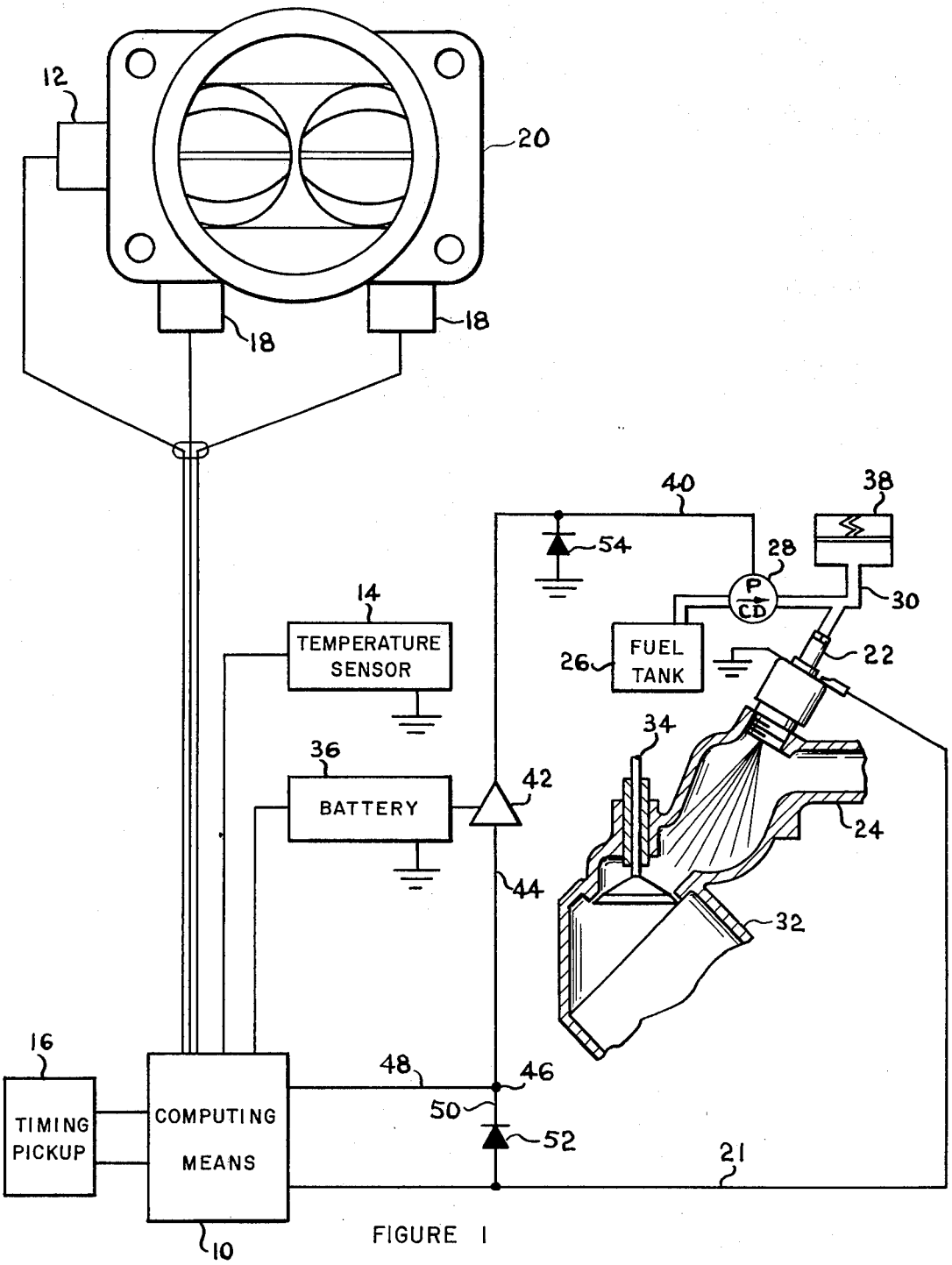

Referring now to the drawing, an electronic fuel control system incorporating the fuel pump control of the present invention is illustrated in schematic form. The electronic fuel control portion of the system is comprised of a computing means 10, a manifold pressure sensor 12, a temperature sensor 14, an input timing means 16, and various other parameter sensors denoted as 18. The manifold pressure sensor 12 and the associated other sensors 18 are mounted on throttle body 20. The output of the computing means 10 is coupled via output conductor 21 to an electromagnetic injector valve member 22 mounted in intake manifold 24 and arranged to provide fuel from fuel tank 26 via pumping means 28 and suitable fuel delivery conduit means 30 to a combustion chamber 32 of an internal combustion engine not otherwise shown. While the injector valve member 22 is illustrated as delivering a spray of fuel towards an open intake valve 34, it will be understood that this representation is merely illustrative and that other delivery arrangements are known and utilized. Furthermore, it is well known in the art of electronic fuel control systems that computing means 10 may control an injector valve means comprised of one or more injector valve members 22 arranged to be actuated singly or in groups of varying numbers and in a sequential fashion as well as simltaneously. The computing means 10 is shown here as energized by battery 36 which could be a vehicle battery and/or vehicle battery charging system or a separate auxiliary battery. An accumulator/pressure regulator 38 is illustrated as coupled to fuel conduit means 30. Accumulator 38 may be either upstream or downstream of the inlets to the fuel injector valve means 22. Furthermore, one or more accumulators may be used although preferably, the fuel conduit means 30 will be so arranged that a single accumulator/pressure regulator will suffice.

Fuel pumping means 28 is illustrated as a constant displacement pump controlled by input conductor 40. Conductor 40 is connected to the output of amplifier 42 which is suitably energized by battery 36. Conductor 44 is operative to couple the input of amplifier 42 to common circuit location 46. Conductor 48 interconnects computing means 10 with common circuit location 46 while input signal means 44 is also connected via conductor 50 and diode 52 to the computing means 10 output lead 21.

OPERATION

Upon receipt of suitable electrical signals over conductor 40, the constant delivery pump 28 will extract fuel from the fuel tank 26 and will store it in the accumulator/pressure regulator 38. Accumulator 38 may be so designed and constructed that fuel stored therein will be under a substantially constant pressure. This pressure may be selected by the system designer to provide the desired amount of fuel atomization and delivery through the injector valve means 22. The energizing signal received by pump 28 over conductor 40 is processed by amplifier 42 so as to be of sufficient energy to provide the energy necessary to activate pump 28.

Amplifier 42 receives input signals over conductor 44, which signals are derived from one of two alternative sources. The alternative sources are coupled to circuit location 46 for their cumulative effect. The first of these alternative sources is over conductor 48 which communicates circuit location 46 directly to the electronic control unit 10. The second of these sources is communicated to circuit location 46 by way of conductor 50 and diode 52 from injector valve means energizing conductor 21.

The first of these sources is operative when the system is initially energized to insure that the fuel pump 28 will operate (in the absence of an injection command) to charge the accumulator 38. This signal may be derived from a suitable timed duration signal generating source within the electronic control unit such as the well known monostable multivibrator or it may be derived from any other convenient source of timed signal. The second source of input signal to amplifier 42 is the injector valve means energizing pulses transmitted from electronic control unit 10 via conductor 21 to the injector valve means 22. By this mechanism, the fuel pumping means 28 will be periodically energized in timed relationship with the energization of the injector valve means 22, so that, as fuel is extracted from accumulator 38 to supply a particular injection sequence, the fuel pumping means 28 will be simultaneously energized so as to pump sufficient quantities of fuel to the upstream fuel delivery system to replace that extracted from the accumulator 38.

Accumulator 38 is therefore operative to accomplish two specific functions. Firstly, the accumulator guarantees that the fuel pressure at the closed injector valve means will be substantially that pressure selected by the system designer to provide the adequate quantities of injection and fuel atomization. Secondly, accumulator 38 is operative to overcome the mechanical and hydraulic time delays incident when energizing fuel pumping means 28 in substantial synchronism with the injector valve means energizing pulses. Diode 52 is operative to isolate common circuit location 46 from the injector valve means 22 input conductors 21 so as to avoid energizing the injector valve means during the initial energization of the fuel pumping means 28 (which is used to provide the initial charge in accumulator/pressure regulator 38.

An additional diode 54 is illustrated as communicating the fuel pumping means 28 input lead 40 to ground. It will be observed that the present invention accomplished the stated objectives, however, the embodiments presented hereinabove should be recognized as exemplary only and that various modifications, changes and variations may be made without departing from the spirit of the invention. For example, the polarity of the various diodes illustrated may be reversed, or in the alternative need for these diodes may be eliminated by slight modifications in the circuitry. Furthermore, a cutoff switch may be provided within accumulator/-pressure regulator 38 so as to turn off fuel pumping means 28 whenever the accumulator is fully charged. Additionally, a plurality of injector valve means energizing conductors 21 may be required to energize a portion of injector valve means 22 in systems which do not utilize simultaneous injection. In such systems, the present invention would require either that diode 52 and conductor 50 connect common circit location to a source of injection valve pulse signal common to all injector channels or that a plurality of diodes 52 and conductors 50 be used to connect common circuit location to each injector valve means energizing conductor 21 which carries a discrete injection pulse.

I claim:

1. A non-return fuel supply system for a fuel injection system having an electronic control unit generating intermittent control pulses and one or more fuel injector valves adapted to be actuated in timed duration by said control pulses, the improvement comprising:

a fuel supply tank;

fuel pump means connected to said supply tank for pressuring fuel received therefrom in response to energization of the fuel pump means;

fuel delivery conduit means for receiving the entire pressurized fuel output of the fuel pump means and adapted to supply said entire fuel output to the injectors;

fuel accumulator means connected to said fuel delivery conduit means for regulating pressure and storing fuel therein;

first control means coupling said electronic control unit and both said fuel pump means and said injector means operative to normally energize said fuel pump means and provide said control pulses to said injector valves.

second control means coupling electronic control unit and said pump means operative for a predetermined duration commenced when said system is first energized to energize said fuel accumulator means to a fluid pressure and volume sufficient for initial injection; and means connecting said first and second control means for preventing said second control means from energizing said injector valves during said predetermined duration.

2. A non-return fuel supply system as claimed in claim 1. wherein said control pulses intermittently energizes said fuel pump means in synchronization with the energization of the injectors.

* * * * *